US006457584B1

(12) United States Patent
Murtishaw et al.

(10) Patent No.: US 6,457,584 B1
(45) Date of Patent: Oct. 1, 2002

(54) PROTECTIVE STORAGE COVERING FOR CATHODE RAY TUBE COMPONENTS AND METHOD OF MAKING

(75) Inventors: David Allen Murtishaw, Sun City, CA (US); Brian Michael Solomich, San Diego, CA (US); Edward Martinez, Vista, CA (US)

(73) Assignees: Sony Corportation, Tokyo (JP); Sony Electronics, Inc., Park Ridge, NJ (US)

( * ) Notice: Subject to any disclaimer, the term of this patent is extended or adjusted under 35 U.S.C. 154(b) by 0 days.

(21) Appl. No.: 09/825,047

(22) Filed: Apr. 3, 2001

(51) Int. Cl.[7] ..... B65D 85/42; B65D 81/26
(52) U.S. Cl. ..... 206/419; 206/204; 206/497
(58) Field of Search ..... 206/418–422, 206/497, 499, 204

(56) References Cited

U.S. PATENT DOCUMENTS

| | | | | | |
|---|---|---|---|---|---|
| 2,806,594 | A | * | 9/1957 | Muller et al. | 206/419 |
| 3,227,357 | A | * | 1/1966 | Knapp et al. | 206/422 |
| 3,583,559 | A | * | 6/1971 | Brander | 206/422 |
| 3,596,830 | A | * | 8/1971 | McFarland et al. | 206/420 |
| 3,717,245 | A | * | 2/1973 | Brander et al. | 206/422 |
| 3,809,223 | A | * | 5/1974 | Kendall | 206/204 |
| 3,930,579 | A | * | 1/1976 | Kurtz | 206/419 |
| 3,955,675 | A | * | 5/1976 | Kurtz | 206/419 |
| 3,961,707 | A | * | 6/1976 | Lehr et al. | 206/419 |
| 4,241,830 | A | * | 12/1980 | Di Gesu' | 206/422 |
| 4,763,787 | A | * | 8/1988 | Koenig | 206/420 |
| 4,860,894 | A | * | 8/1989 | Koenig | 206/421 |

FOREIGN PATENT DOCUMENTS

| | | | | |
|---|---|---|---|---|
| JP | 1-254577 | * | 11/1989 | 206/418 |

* cited by examiner

*Primary Examiner*—Bryon P. Gehman
(74) *Attorney, Agent, or Firm*—Steven L. Nichols

(57) ABSTRACT

A protective cover is placed over a rack of cathode ray tube components to prevent contamination of the components and/or moisture damage to the components. Some cathode ray tube components, particularly funnels, are stockpiled so that assembly lines can be kept running even if the supply of the component becomes temporarily exhausted. However, these stockpiled funnels must be protected while in storage. The protective cover described herein can be fastened in place around a rack or pallet containing a stockpile of funnels. The protective cover can also incorporate moisture-absorbent elements to prevent moisture damage to the stockpiled funnels.

6 Claims, 4 Drawing Sheets

PROTECTIVE STORAGE COVERING FOR CATHODE RAY TUBE COMPONENTS AND METHOD OF MAKING

FIELD OF THE INVENTION

The present invention relates to the field of cathode ray tube manufacture. More particularly, the present invention relates to storing a supply of cathode ray tube components, particularly funnels, for use in the cathode ray tube manufacturing process. The present invention provides a protective covering for maintaining the quality and integrity of cathode ray tube components while those components are in storage awaiting assembly.

BACKGROUND OF THE INVENTION

Cathode ray tubes ("CRTs") are used in most television sets and computer and video monitors. The CRT is a glass tube with a bottle-like shape in which a relatively flat bottom portion narrows into an elongated neck portion. (see, e.g., FIG. 1, 100). The relatively flat portion of the CRT becomes the screen on which the display of the television set or monitor is generated when the CRT is incorporated therein. Phosphor, a material that emits light when struck by an electron beam, is coated over the screen portion of the CRT.

An electron gun is then installed in the neck of the CRT. A stream of electrons emitted from the electron gun is scanned over the phosphor and turned on and off during the scanning to cause the phosphor to glow in certain places and not others. In very simple terms, this is how an image is generated on the screen of a television or video monitor.

A yoke is provided around the neck of the CRT. This yoke produces a changing magnetic field through which the electron beam from the electron gun passes. The electron beam is deflected by the magnetic field of the yoke. Consequently, by varying the magnetic field created by the yoke in a precise cycle, the electron beam can be scanned, line-by-line, over the entire surface of the screen to generate video images thereon.

It is very important to ensure that no dust or other contaminants are allowed into the CRT during manufacture, and particularly before and during the installation of the electron gun. Contaminants that remain in the CRT when the electron gun is operating can degrade the performance of the CRT and even cause damage to the tube.

Generally, the neck or funnel portion of the CRT is manufactured separately from the relatively flat display portion. The display portion is then attached to the funnel using molten glass known as frit. The frit cools and seals the display portion to the funnel to complete the tube. Obviously, great care must be taken before the funnel and display portions of the CRT are sealed together to ensure that no dust or other contaminants lodge on the components.

Additionally, it is important to keep the CRT components dry. In particular, moisture can degrade the quality of the final before the final is incorporated into a completed CRT.

While it is necessary to keep CRT funnels clean and dry before they are incorporated into a CRT, it has also been the practice in CRT manufacture to maintain a supply of funnels so that the CRT production line can be kept going even if the supply of funnels is temporarily interrupted. Having a supply of funnels as a buffer for the production line ensures that the production line will not have to stop or slow down if the supply of funnels is temporarily exhausted.

Obviously, however, the longer funnels are stored to support the production line, the more likely it is that the funnels will be damaged by moisture or contaminated by dust or other contaminants. Consequently, there is a need in the art for a means and method of protecting CRT components, particularly funnels, from contamination and moisture damage prior to being used to assemble a CRT in a production line.

SUMMARY OF THE INVENTION

The present invention meets the above-described needs and others. Specifically, the present invention provides a means and method of protecting CRT components, particularly funnels, from contamination and moisture damage prior to being used to assemble a CRT in a production line.

Additional advantages and novel features of the invention will be set forth in the description which follows or may be learned by those skilled in the art through reading these materials or practicing the invention. The advantages of the invention may be achieved through the means recited in the attached claims.

The present invention may be embodied and described as a protective covering for cathode ray tube components that have been stockpiled to support an assembly line. The protective covering preferably includes a protective cover sized to cover and provide a protected environment for the stockpile of a cathode ray tube component; and a fastener for fastening the protective cover in place over the stockpile of a cathode ray tube component. The cathode ray tube component being stockpiled may be a funnel.

The stockpile of the cathode ray tube component is preferably a rack on which a supply of the cathode ray tube component is stored. In such a case, the fastener may fasten the protective cover to the rack. The rack may be placed on a pallet or the supply of the cathode ray tube component may be placed on a pallet. In such a case, the fastener may fasten the protective cover to the pallet.

Preferably, the protective covering also provides a moisture-absorbent element for preventing moisture from damaging the stockpile of a cathode ray tube component. The moisture-absorbent element may be disposed in a number of pockets which are on an inside surface of the protective cover. Preferably, the moisture-absorbent element is a number of silica packs.

The present invention also encompasses the methods of making and using the protective covering described above. Specifically, the present invention encompasses a method of protecting cathode ray tube components that have been stockpiled to support an assembly line by covering the stockpile of a cathode ray tube component with a protective cover that is sized to cover and provide a protected environment for the stockpile of a cathode ray tube component. This method also preferably includes fastening the protective cover in place over the stockpile of a cathode ray tube component.

BRIEF DESCRIPTION OF THE DRAWINGS

The accompanying drawings illustrate preferred embodiments of the present invention and are a part of the specification. Together with the following description, the drawings demonstrate and explain the principles of the present invention.

DETAILED DESCRIPTION OF THE PREFERRED EMBODIMENTS

According to the principles of the present invention, funnels for use in manufacturing Cathode Ray Tubes ("CRTs") can be stored, for example, on a rack, and covered with a protective covering that prevents dirt, dust and other contaminants from lodging on the funnels. The protecting covering can also contain moisture-absorbent materials that prevent moisture from damaging the funnels.

Figure 1:
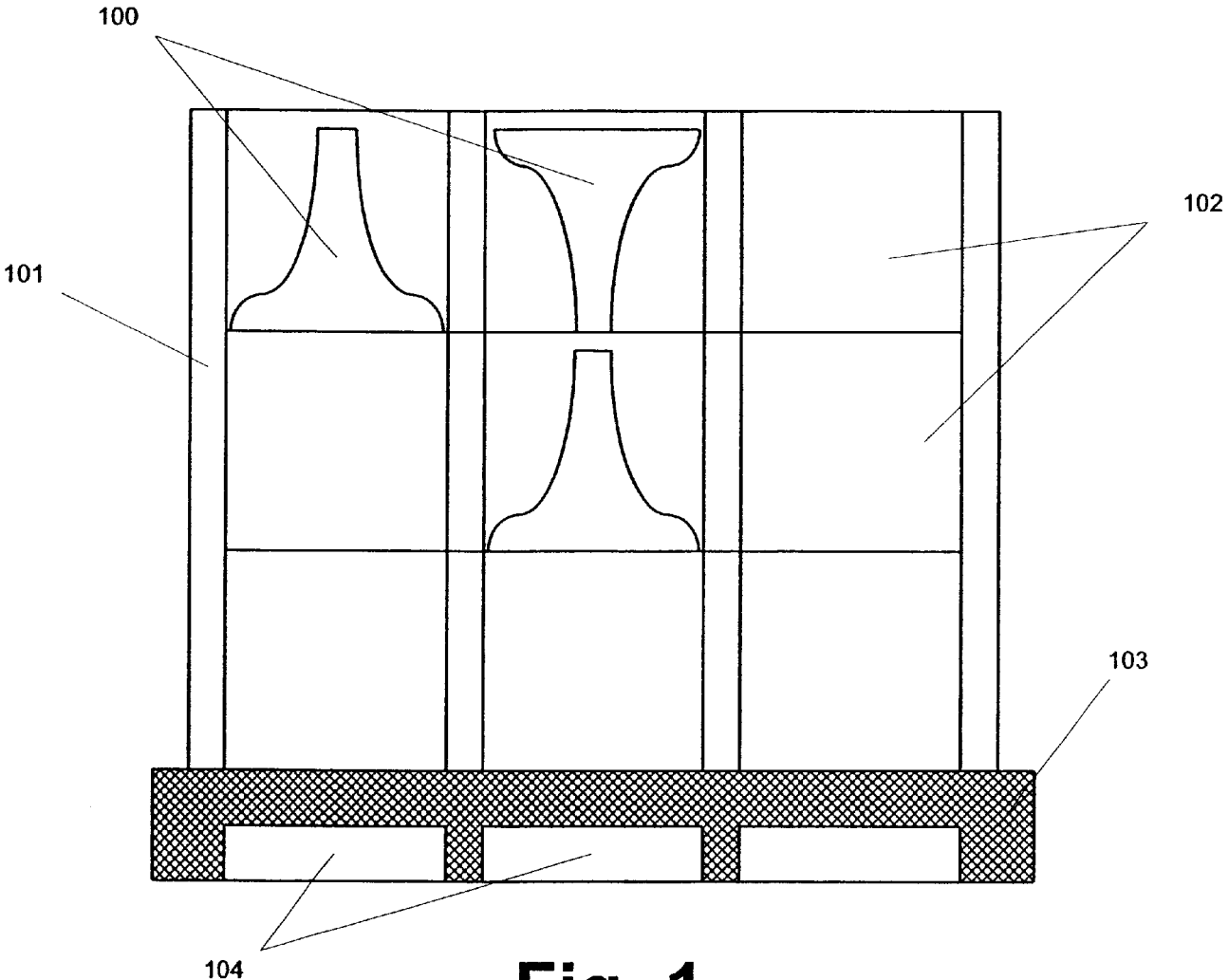
FIG. 1 is an illustration of a funnel storage system according to the present invention.

Using the drawings, the preferred embodiments of the present invention will now be explained. FIG. 1 is an illustration of a funnel storage system according to the present invention. As shown in FIG. 1, a number of funnels (100) are stored in a rack (101). The funnels (100) may be in various stages of manufacture. For example, the funnels may or may not have a display portion sealed to the large end of each funnel. In a particularly preferred embodiment, the funnels are held in storage to support the P-1 process in which carbon or other material is applied as a coating on the interior of the funnel. The present invention is not restricted to any particular phase of the CRT manufacturing process, but can be used to protect CRT components whenever necessary.

The rack (101) is preferably disposed on a pallet (103). The rack (101) may be secured to the pallet (103), for example by being bolted or screwed to the pallet. Alternatively, the rack (101) may simply rest on the pallet (103).

With the rack (101) on the pallet (103), the supply of funnels (100) can be easily moved into, out of and between designated storage areas. Openings (104) in the pallet (103) allow the forks of a forklift, for example, to pass through the pallet (103) so that the pallet (103) can be lifted and moved as needed by appropriate machinery.

Figure 2:
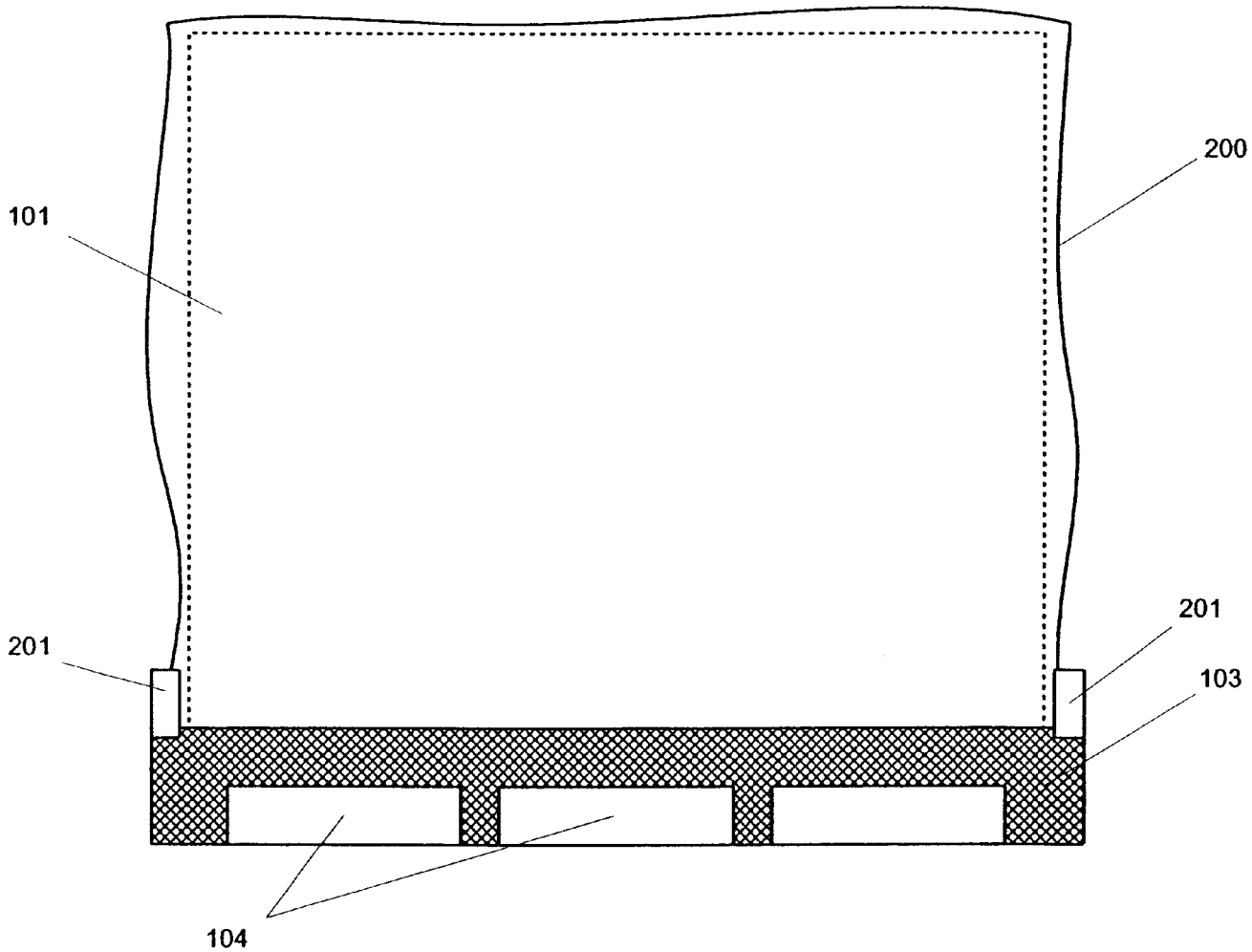
FIG. 2 is an illustration of a protective covering for the funnels in the funnel storage system of FIG. 1 according to a first embodiment of the present invention.

Under the principles of the present invention, after the funnels (100) are placed in the rack (101) for storage, the rack (101) and funnels (100) are covered and sealted in a protective covering that prevents contaminants from lodging on the funnels (100). FIG. 2 is an illustration of a preferred embodiment of the protective covering of the present invention.

As shown in FIG. 2, the protective cover (200) is draped over the rack (101) to protect the funnels (100) that are in the funnel storage system of FIG. 1. The rack (101) is illustrated in ghost in FIG. 2. The protective cover (200) covers the funnels (100) and thereby prevents any contaminants from lodging on the funnels. The cover (200), itself, must be kept clean and free from contaminants.

Preferably, the protective cover (200) will be sealed or fastened over the funnels (100) to ensure that the funnels (100) remain protected while in storage. In one preferred embodiment, clips or other fasteners (201) are provided on the pallet (103). These fasteners (201) are secured to the protective cover (200) to hold the cover (200) in place over the rack (101) and funnels (100). The bottom of the pallet (103) is preferably formed in such a way as to prevent contaminants or moisture from entering the protective cover (200) from below.

The fasteners (201) may be any type of fastener capable of securing the cover (200) over the rack (101) and funnels (100). For example, the fasteners (201) may be clips, snaps, buttons, Velcro™ strips, zippers, staples, tacks, nails, ties, etc.

Where appropriate, depending on the type of fastener used, one portion of the fastener will be disposed on the pallet (103). The corresponding portion of the fastener is then disposed on the protective cover (200). The respective portions of the fastener (201) are then joined when the cover (200) is placed over the rack (101) so as to seal the environment in which the funnels (100) are stored.

The fasteners (201) may be disposed all around the perimeter of the pallet (103) so as to completely seal the environment in which the funnels (100) are stored. Alternatively, the fasteners (201) may be placed at intervals around the perimeter of the pallet (103) to hold the cover (200) in place to the degree required.

Figure 3:
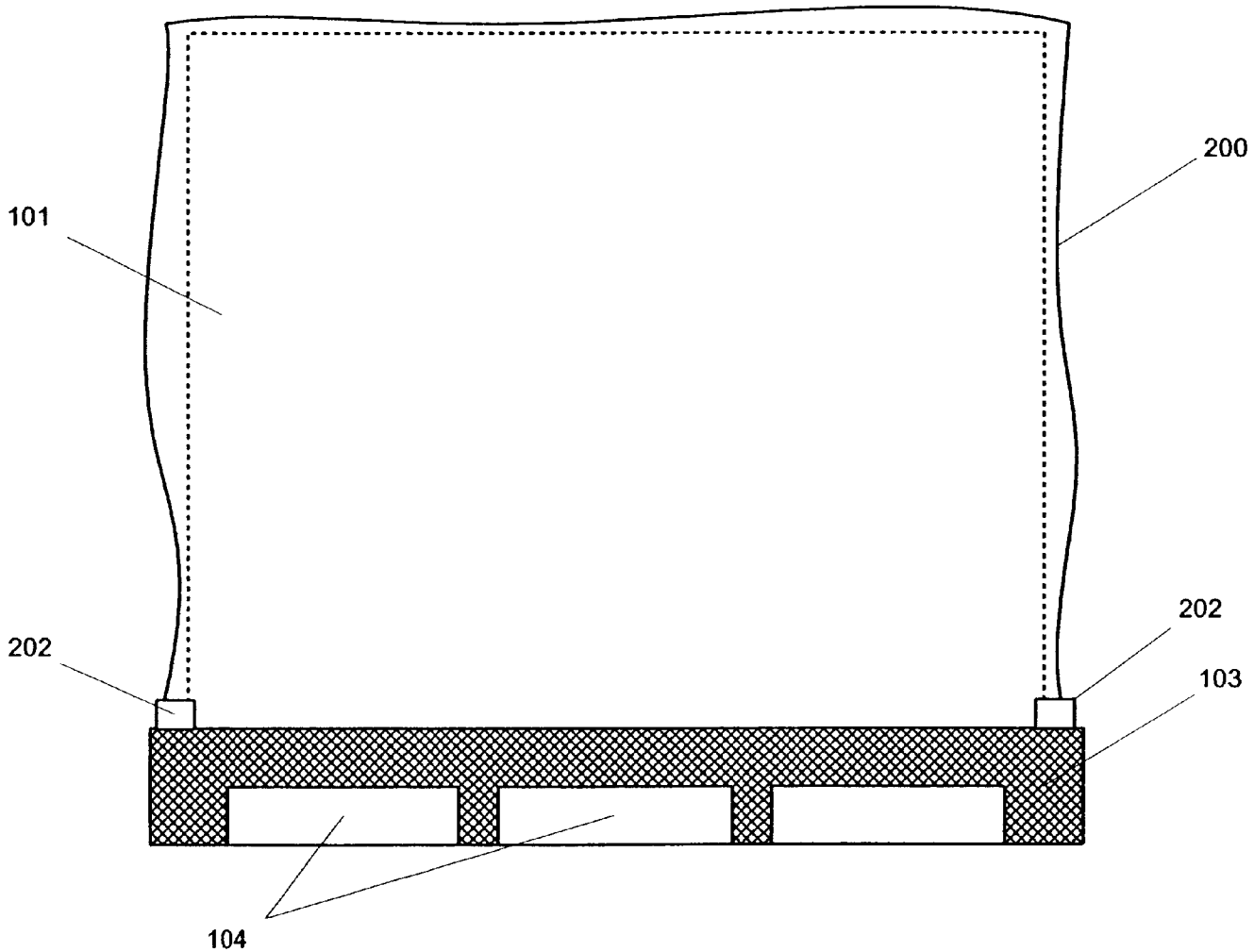
FIG. 3 is an illustration of a protective covering for the funnels in the funnel storage system of FIG. 1 according to a second embodiment of the present invention.

FIG. 3 is an illustration of a protective covering for the funnels in the funnel storage system of FIG. 1 according to a second embodiment of the present invention. As shown in FIG. 3, the protective cover (200) is again draped over the rack (101) to protect the funnels (100) that are in the funnel storage system of FIG. 1. The rack (101) is again illustrated in ghost in FIG. 3. As before, the protective cover (200) covers the funnels (100) and thereby prevents any contaminants from lodging on the funnels. The cover (200), itself, must be kept clean and free from contaminants.

Preferably, the protective cover (200) will be sealed or fastened over the funnels (100) to ensure that the funnels (100) remain protected while in storage. In this preferred embodiment, clips or other fasteners (202) are provided on the rack (101). These fasteners (202) are secured to the protective cover (200) to hold the cover (200) in place over the rack (101) and funnels (100). The bottom of the rack (101) is preferably formed in such a way as to prevent contaminants or moisture from entering the protective cover (200) from below.

As in the first embodiment described above, the fasteners (202) may be any type of fastener capable of securing the cover (200) over the rack (101) and funnels (100). For example, the fasteners (202) may be clips, snaps, buttons, Velcro™ strips, zippers, staples, tacks, nails, ties, etc. Where appropriate, depending on the type of fastener used, one portion of the fastener will be disposed on the rack (101). The corresponding portion of the fastener is then disposed on the protective cover (200). The respective portions of the fastener (202) are then joined when the cover (200) is placed over the rack (101) so as to seal the environment in which the funnels (100) are stored.

The fasteners (202) may be disposed all around the perimeter of the rack (101) so as to completely seal the environment in which the funnels (100) are stored. Alternatively, the fasteners (202) may be placed at intervals around the perimeter of the rack (101) to hold the cover (200) in place to the degree required.

Figure 4:
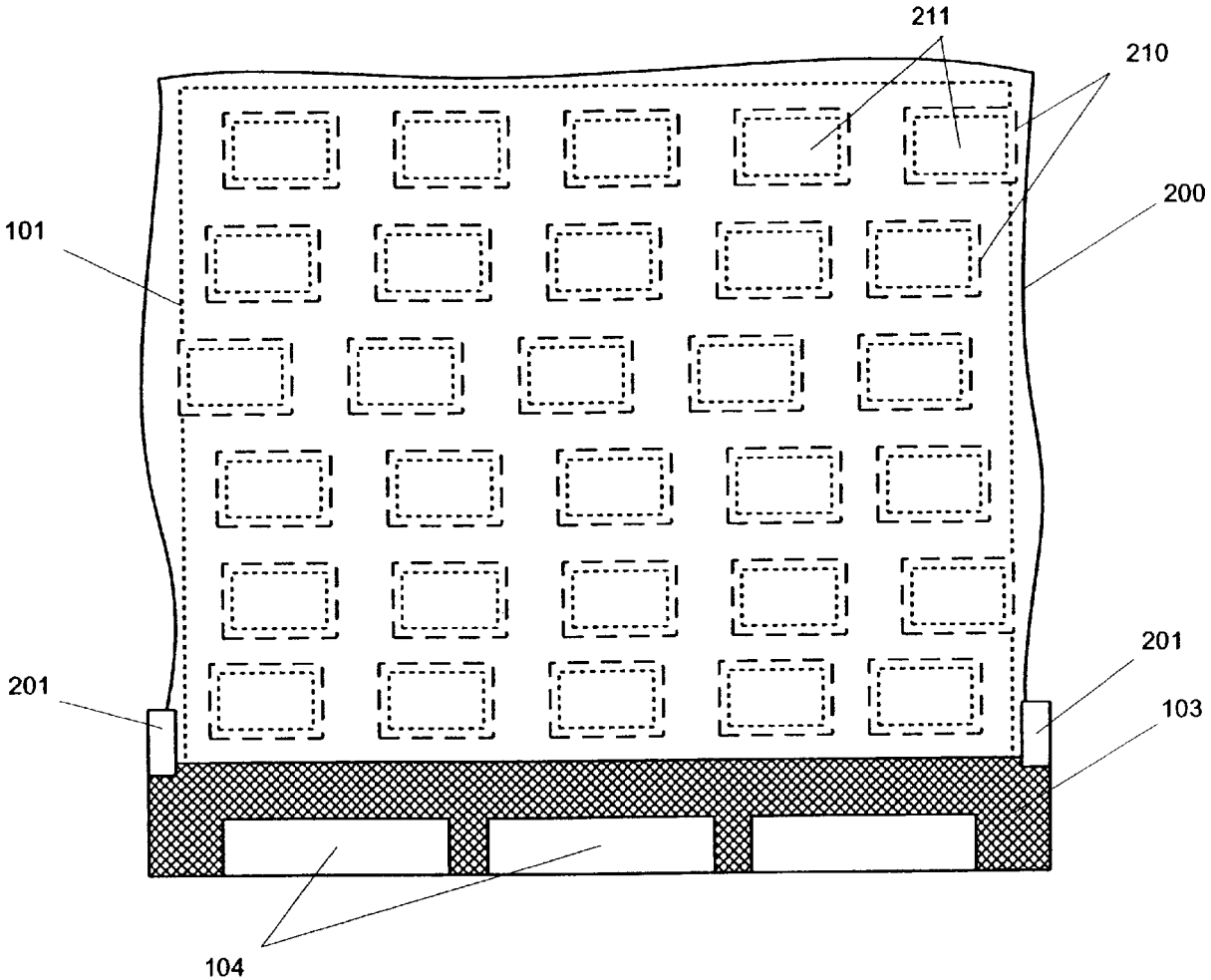
FIG. 4 is an illustration of additional features of the protective coverings of FIGS. 2 and 3 which protect the stored funnels against moisture damage according to the principles of the present invention.

FIG. 4 is an illustration of additional features of the protective covering of FIGS. 2 and 3. These features of the protective covering (200) protect the stored funnels (100) against moisture damage according to the principles of the present invention. The funnels (100) may contain or have coated thereon materials which are necessary to operation of a completed CRT, but which can absorb and be degraded by water or moisture. Carbon material is an example of such a material of the funnels (100) that can absorb water or moisture thereby damaging the usefulness of the funnel.

To prevent these problems, the protective cover (200) of the present invention may include a moisture absorption element to prevent moisture from reaching and damaging the CRT components being stored under the protective cover (200). In a preferred embodiment, illustrated in FIG. 2, a number of pockets (210) are provided on the inside of the protective cover (200). Each of these pockets (210) contains a moisture-absorbent element (211), for example, a silica pack.

The pockets (210) may be made of a mess or netted material to allow moisture to flow freely to, and be absorbed by, the silica packs (211). Alternatively, the pockets (210) may be solid material to prevent any contamination from the silica packs (211) from lodging on the funnels. The pockets (210) may also include fasteners so that each pocket can be fastened shut to hold the moisture-absorbent element (211) in the pocket (210). The pockets (210) could be sealed, but preferably can be opened as needed to replace or replenish the moisture-absorbent element.

As an alternative to the pockets (210) illustrated in FIG. 4, the inside of the protective cover (200) could incorporate a layer of moisture-absorbent material.

This layer of material would prevent moisture from collecting on or damaging the stored CRT components, but could not be replaced or replenished in the same manner as moisture-absorbent elements in a pocket system as shown in FIG. 4.

The preceding description has been presented only to illustrate and describe the invention. It is not intended to be exhaustive or to limit the invention to any precise form disclosed. Many modifications and variations are possible in light of the above teaching.

The preferred embodiment was chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

What is claimed is:

1. A protective covering for cathode ray tube components that have been stockpiled to support an assembly line, said protective covering comprising:

a protective cover covering and providing a protected environment for a stockpile of a cathode ray tube component;

a fastener for fastening said protective cover in place over the stockpile of a cathode ray tube component; and a moisture-absorbent element for preventing moisture from damaging the stockpile of a cathode ray tube component.

2. The protective covering of claim 1, wherein said moisture-absorbent element is disposed in a plurality of pockets which are on an inside surface of said protective cover.

3. The protective covering of claim 2, wherein said moisture-absorbent element is a plurality of silica packs.

4. A method of protecting cathode ray tube components that have been stockpiled to support an assembly line, said method comprising:

covering a stockpile of a cathode ray tube component with a protective cover sized to cover and provide a protected environment for the stockpile of a cathode ray tube component; and absorbing moisture with a moisture-absorbent element incorporated with said protective cover for preventing moisture from damaging the stockpile of a cathode ray tube component.

5. The method of claim 4, further comprising disposing said moisture-absorbent element in a plurality of pockets which are on an inside surface of said protective cover.

6. A protective cover for cathode ray tube components that have been stockpiled to support an assembly line, said protective cover comprising means for protectively covering a stockpile of a cathode ray tube component, said covering means covering and providing a protected environment for the stockpile;

means for fastening said covering means in place over the stockpile of a cathode ray tube component; and means for absorbing moisture to prevent moisture from damaging the stockpile of a cathode ray tube component.

* * * * *